US005586347A

United States Patent [19]

Frischknecht

[11] Patent Number: 5,586,347

[45] Date of Patent: Dec. 24, 1996

[54] MATTRESS WITH AN INTEGRATED AIR SYSTEM

[75] Inventor: Willi Frischknecht, Schönengrund, Switzerland

[73] Assignee: Airlux AG, Regensdorf, Switzerland

[21] Appl. No.: 295,751

[22] PCT Filed: Apr. 30, 1993

[86] PCT No.: PCT/CH93/00110

§ 371 Date: Sep. 15, 1994

§ 102(e) Date: Sep. 15, 1994

[87] PCT Pub. No.: WO93/21803

PCT Pub. Date: Nov. 11, 1993

[30] Foreign Application Priority Data

May 6, 1992 [CH] Switzerland ..... 1449/92

[51] Int. Cl.[6] ..... A47C 27/08

[52] U.S. Cl. ..... 5/713; 5/708

[58] Field of Search ..... 5/499, 454, 453

[56] References Cited

U.S. PATENT DOCUMENTS

| | | | |
|---|---|---|---|
| 2,068,134 | 1/1937 | Houghton | 5/454 |
| 3,068,494 | 12/1962 | Pinkwater | 5/454 |
| 3,112,502 | 12/1963 | Forsberg | 5/454 |
| 3,133,696 | 5/1964 | Mirando | 5/454 |
| 3,155,991 | 11/1964 | Dunham | 5/454 |
| 3,583,008 | 6/1971 | Edwards | 5/454 |
| 4,896,387 | 1/1990 | Malcolm et al. | 5/454 |
| 4,912,861 | 4/1990 | Huang | 5/449 |
| 4,930,174 | 6/1990 | Hunter | 5/454 |

FOREIGN PATENT DOCUMENTS

| | | | |
|---|---|---|---|
| 265969 | 12/1913 | Germany | 5/454 |

*Primary Examiner*—Michael J. Milano

*Attorney, Agent, or Firm*—Bardehle, Pagenberg, Dost Altenburg, Frohwitter, Geissler & Partners

[57] ABSTRACT

A mattress having an integral air system responding to a load pressure. Included are a pump body (1), an air reservoir (2), air pipes (7), one-way valves (3), a manually adjustable pressure regulating valve (5) provided with a scale (6) and an insulated air cell (4). The pressure is maintained in air cell (4) when air is being squeezed from pump bodies (1) and pushed into the unpressurized reservoir (2) by way of the one-way valves (3) when a user of the mattress creates a zone-wise load pressure. The compressed air in reservoir (2) remains as a reserve therein and equalizes the in air cell (4) dropping pressure having been lost due to diffusion. The equalization is controlled by a need adjustable pressure regulating valve (5) having an adjusting knob (15) and a scale (6) thereon. The thus manufactured mattresses are adjustable in their support capabilities from soft to hard. The mattress can thereby be matched to the needs of a user. The adjusted air pressure in air cell (4) by way of scale (6) and thereby the degree of firmness will be maintained over an unlimited period of time because of the integrated air system. A manual or any other refilling of the air is superfluous.

11 Claims, 5 Drawing Sheets

MATTRESS WITH AN INTEGRATED AIR SYSTEM

The invention is concerned with a mattress for beds and cushions for sitting furniture equipped with an air system which reacts to load pressures.

Mattresses are especially suitable for beds when filled with air. They offer superior comfort when lying or sitting. A special characteristic of air mattresses is that the support capability is adjustable from soft to hard. Because of their adaptability, they are suitable for normal use as well as for therapeutic purposes.

Air is suitable as a support element and for maintaining the bed climate in a superior manner. Air cells are light weight. Air neither deteriorates nor does it need any chemical additions or any heating. The support capability of an air cell is adjustable in a stepless manner by compressing the air contained therein.

A disadvantage of air-filled mattresses or cushions has been that small amounts of air can escape through diffusion. These losses of air have to be resupplied to the air cell. So far, this has been accomplished in a manual manner or by using electric devices. These facts made commercially viable air-filled mattresses impossible to a large extent.

It is an object of the invention to create a mattress having an integrated during use self-refilling air system.

DESCRIPTION OF THE FUNCTION

When a mattress or cushion is loaded with the body weight of a user, pressure is created in different zones. This pressure is intensified at the beginning of use or at the end of use, especially at the edges of the mattress, which results in pressing air from integrated pump body 1 into unpressurized reservoir 2. One-way valve 3 effects the flow of the air in only one direction. The air pushed from pump body 1 is compressed in reservoir 2 and stands by as a reserve. This compressed air reserve equalizes the pressure in air cell 4 up to the value which had been adjusted at pressure regulating valve 5 with the aid of a scale 6. This equalization occurs at the latest when the load is being removed from the mattress. When a load is being removed from an edge area, pump bodies 1, when returning to the initial position, suction ambient air through the one-way valve. The pump, therefore, is ready for a further feeding of air. The adjustable pressure reducing valve 5 together with the compressed air reservoir are instrumental in an exactly dosed feeding of the air cell 4. The scale allows for an exact adjustment of the desired pressure and, thereby, the needed support capability of the mattress. Consequently, the mattress is adjustable from soft to hard in a stepless manner.

The body weight of a person using the mattress and loading of edge zones, squeezes pump bodies 1 and thereby decreases their volume. The air contained in the pump bodies is pushed through air pipes 7 and through the one-way valve 3 into air reservoir 2 and is compressed therein. Thereby, the body weight of a person using the mattress sees to it that through the integrated air system, air under pressure is always present in air reservoir 2, which effects the replenishing and the even support capability of air cell 4. Neither time nor additional energy have to be expended in replenishing the air in the air cell. The air cell in the mattress, while undergoing spaced apart loadings of the system, is always filled to a desirable extent through the use of the mattress, meaning, as adjusted on scale 6.

Mattresses, equipped with air cells, substantially conform themselves to underlying supports which support the same.

When using adjustable bottom mattresses, head and foot elevations as well as sitting positions are entirely possible.

The adaptable and body-friendly air cushion is suitable for a regular user as well as for therapeutic purposes because of its stepless adjustability from soft to hard. The anti-bedsore effect during prolonged confinement to bed is greatly appreciated. In addition, other desirable and therapeutic effects can be achieved, e.g., several air chambers with corresponding pressure regulating valves can be used. For therapeutic applications, special constructions of the air cell 4 can be contemplated. Mattresses/cushions for seating furniture can be realized in a further development. Therefore, the employment of such beds/cushions for therapeutic purposes, which when in use, independently resupply themselves with air, are a welcome addition or relief of existing problems.

Pump body 1 as well as reservoir 2 are manufactured from an air impervious foil. Hose ends 19, welded in at suitable points, allow for the reception of hose connectors for air hoses 7. The hose-like manufactured pump bodies 1 are filled with air permeable foam material having been cut from frame 9. This guarantees a good air volume as well as an excellent recovery capability of pump body 1 even after years of prolonged use. The one-way valves 3 are inserted in such a manner that air can flow in one direction only. This guarantees a perfect functioning of the pump cycle. The air impervious foil 12 used for the air cell is flame-laminated to a thin layer of foam material 13. Thereby, the foil and foam material are homogeneously connected. After the production of the air cell, a layer of cotton cloth, e.g., terry cloth is applied. This method avoids the creation of water condensation in the mattress even under large temperature variances caused by the use of hot water bottles or heating pads. The spaced and oppositely lying foils 12 of the air cell 4 are connected by stays 8 extending in a cross-wise direction. The stays are constructed in such a manner that air can flow through free spaces 24 in sufficient amounts (noise-avoidance). By varying the construction of the air cell, different hard zones can be created. The cross-stays 8, for example, in an air cell of a bed mattress are not fixed with always the same distance. And an enlarged space in the middle area of the air cell, automatically brings more volume and, thereby, greater support capability (middle-zone-strengthening). In air systems designed for seat cushions, the desired effect, namely, increasing support capability in the forward third of a seat and more resistant in the spine area of a back seat can be achieved without difficulty by suitably forming the air cell.

Pressure reducing valve 5 is steplessly adjustable over an extent of 0 to 60 millibars. The attached scale 6 allows for an exact and stepless adjustment of the air pressure in the air cell and thereby, the support capability of the mattress. By using several pressure reducing valves and air cell in mattresses and seat cushions, individually adjustable zones can be created. That is, for example, the firmness of the seat and the seat back can be regulated individually.

The open-cell, air-pervious foam material frame 9 constructed as a support element, conveys the needed stability to the sides of the mattress. The components for supplying the air are built into this frame. By superimposing several pump bodies 1, the efficiency of the air supply is greatly enhanced. As a filling for the pump bodies 1 as well as the reservoir 2, the cylindrical and air-pervious foam parts that were previously cut from the foam material frame for the reception of the pump bodies, are used. The air cell 4 is manufactured from an air-pervious foil 12. This foil is flame-laminated on one side to a layer of foam material 13 prior to its intended use. This homogeneous connection does not inhibit a welding of the foil in any manner, better yet, it serves to insulate and facilitates the later application of a further material such as, for example, cloth material onto air cell 4. Unlaminated foil can be used for connection stays 8 of the air cell as well as for connection strips 10 The form part 17 welded at a suitable point, serves as an air-inlet/outlet for the air cell 4. After welding-in the connection stays 8 as well as the connection strips 10, a further welding of the corners ends the basic construction of air cell 4.

An application of woven material, preferably, cloth material (terry cloth) onto the foam material layer, improves, aside from an insulation, the mechanical strength.

The following components are used in the mattress:

One-way valves (3): The one-way valves allow for the flow of air in only one direction.

Pressure reduction valve (5): Adjustable pressure reduction valves, which are operating on a millibar scale, are especially suitable, because of their reliable construction, for the control of air pressures to an extent of 0 to 60 millibars.

Man-made foil (12): The new generation of man-made foils available on the market are reasonably priced, are environment-friendly during their construction, can be recycled and can be welded easily.

Foam materials (13): The open-celled foam materials used to a great extent in the mattress manufacturing industry.

Cloth materials (14): These are used in bedding in multi-use manners. They serve as in-between layers or as covers.

Filling materials (22): Different organic materials such as cotton, wool, horse hair, but also synthetic fibres may be used.

Cushion materials (23): Available, by choice, are foam material, latex foam, or similar materials.

The drawings show:

Figure 1:
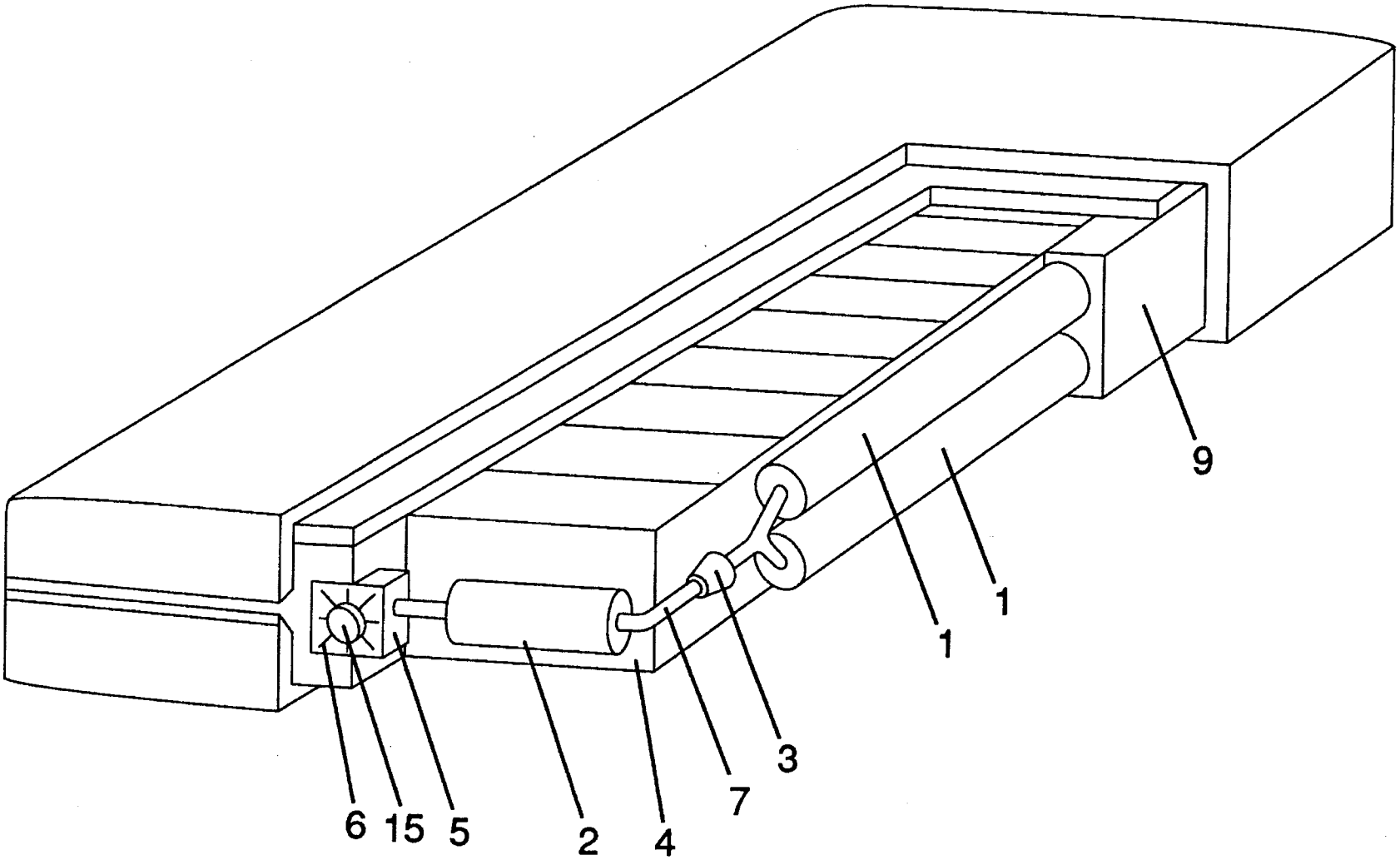
FIG. 1 is a partially cut open mattress.
Figure 2:
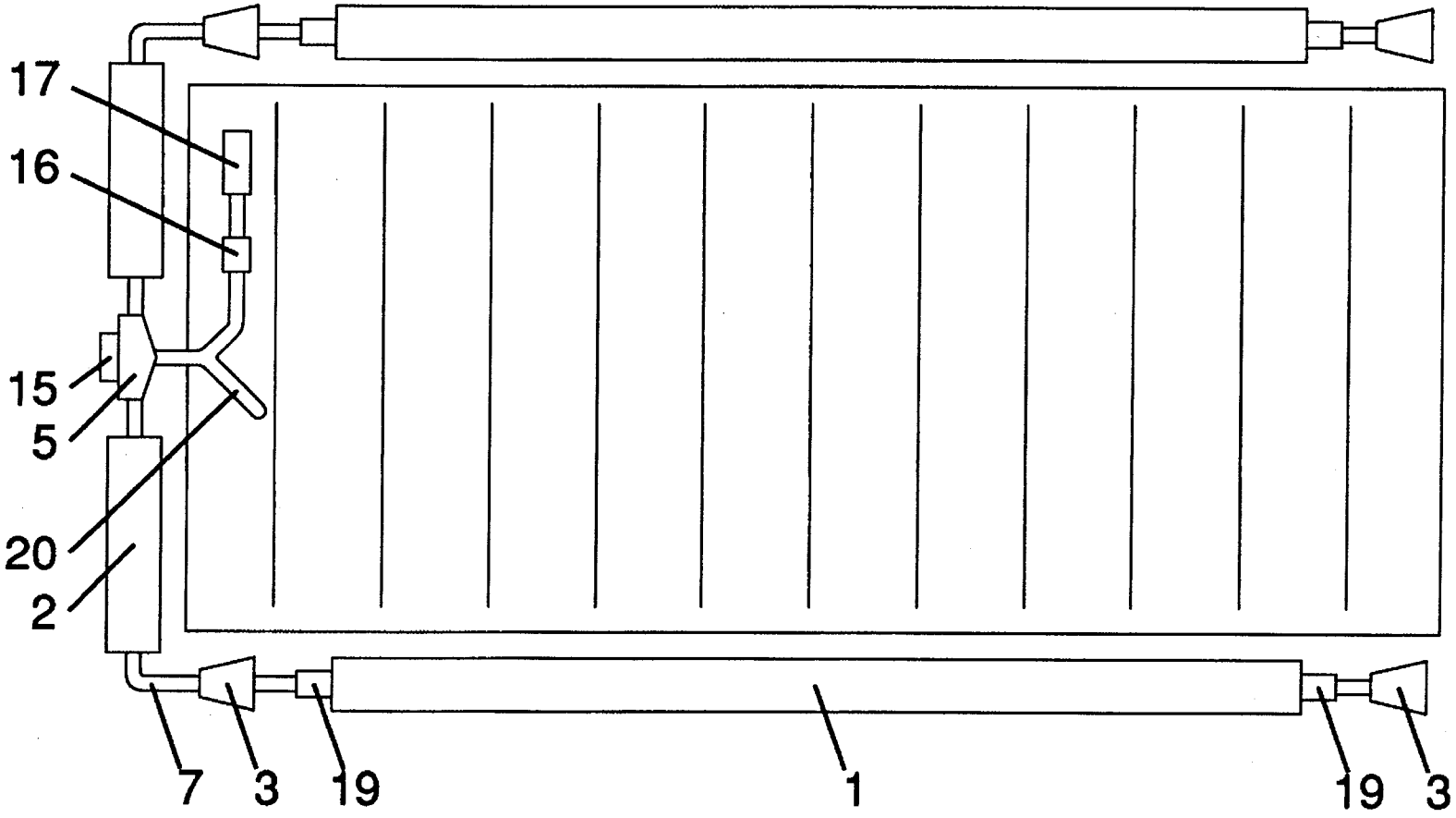
FIG. 2 shows the integrated air system.
Figure 3:
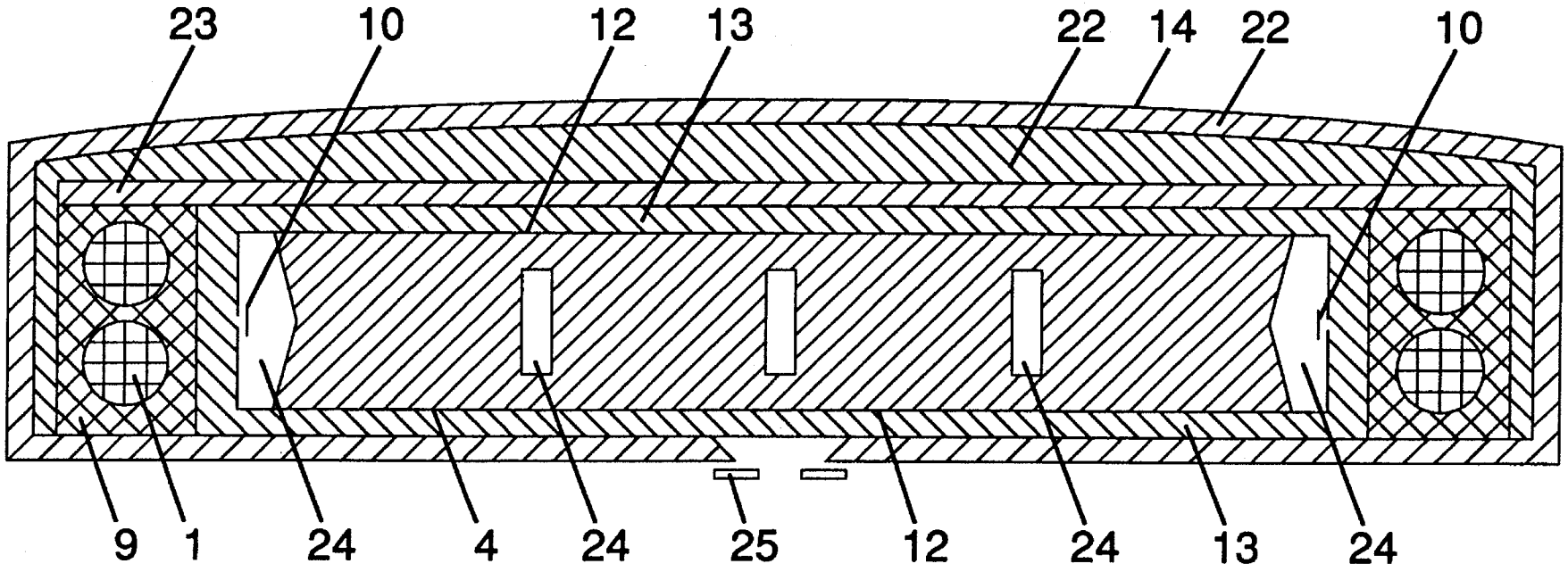
FIG. 3 is a cross-section of a mattress.
Figure 4:
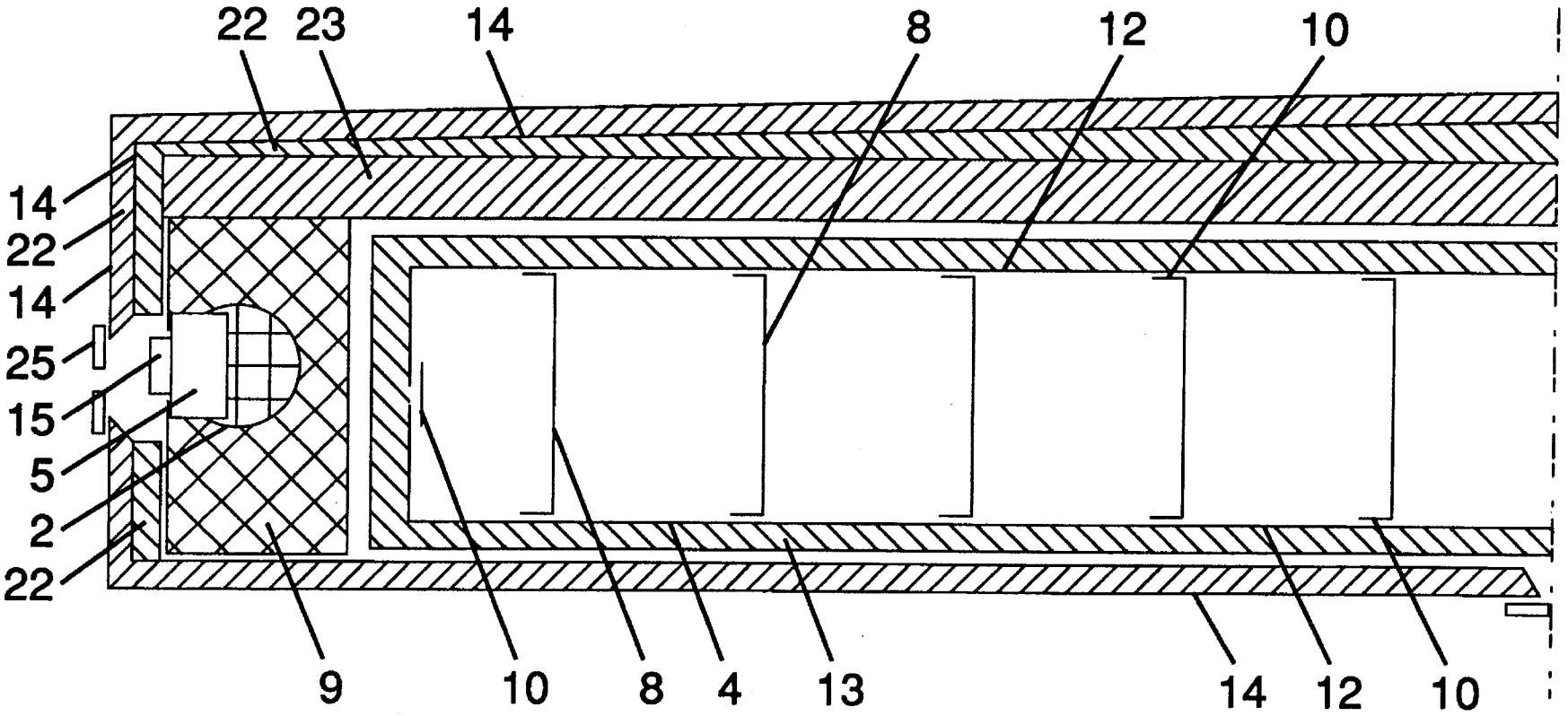
FIG. 4 is a longitudinal cut through of a mattress.
Figure 5:
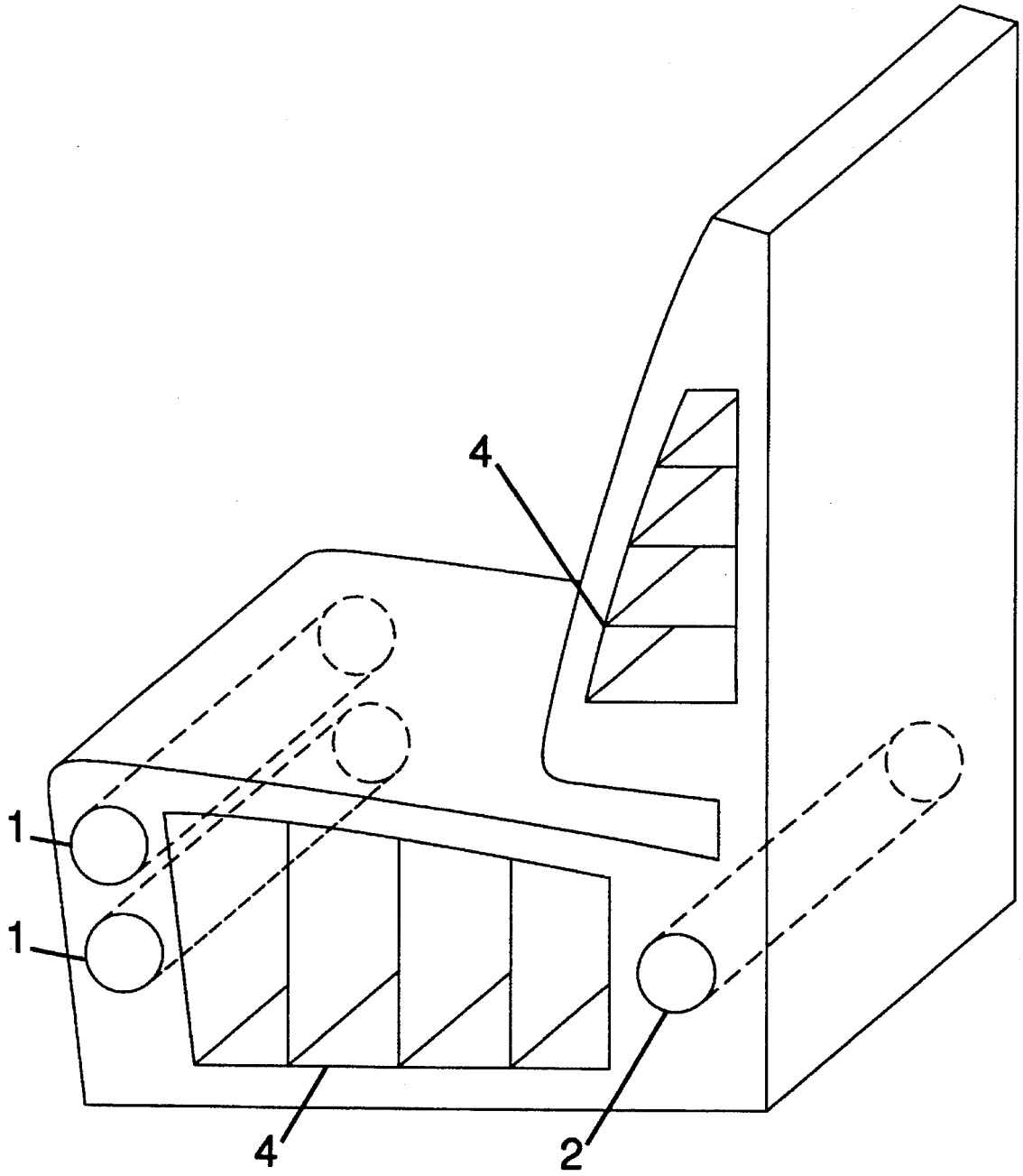
FIG. 5 is a cut through of a seat cushion.

What I claim is:

1. A mattress for beds or seating furniture, the mattress comprising:

a cushion, an air cell, and an in-the-mattress pump system wherein the pump system comprises: a pump body, an air reservoir and a pressure regulating valve, wherein the air cell is connected to the pump system so that said pump system replenishes air lost from said air cell with air from the air reservoir and regulates pressure in the air cell by the pressure regulating valve.

2. The mattress according to claim 1, wherein said pump body is integrated into the mattress so that load pressures on the mattress squeeze said pump body to thereby charge said air reservoir.

3. The mattress according to claim 1 wherein said pump body comprises: a foil; an air-pervious foam material for shape recovery disposed within said foil; and end faces attached to said foil with one-way valves.

4. The mattress according to claim 1 wherein said air reservoir receives an over-pressure created by said pump body and delivers the same to said air cell by way of said pressure regulating valve.

5. The mattress according to claim 1 wherein air pressure in said air cell is steplessly determined and simultaneously held constant therein by means of said pressure regulating valve.

6. The mattress according to claim 1 wherein said pressure regulating valve comprises a scale and a control knob to adjust air pressure in said air cell.

7. The mattress according to claim 1 wherein said air cell comprises a foil comprising an insulation material applied thereon by flame-laminating and further comprising a woven material layer applied thereon.

8. The mattress according to claim 1 further comprising a form part welded into said air cell for air entrance or exit.

9. The mattress according to claim 1 further comprising an air coupling built into an air branch that is connected to said pump system, as well as a valve, wherein said valve is externally activated for air entrance or exit.

10. The mattress according to claim 1 wherein a control knob, attached to said pressure regulating valve, is activated by way of an opening in the shroud of the mattress.

11. The mattress according to claim 1, wherein said pressure regulating valve is adjustable.

* * * * *